United States Patent [19]

Smith

[11] 4,164,193

[45] Aug. 14, 1979

[54] ADJUSTABLE SPINNAKER HEADER AND RIG THEREFOR

[76] Inventor: Milton B. Smith, 1253 N. Bundy, Los Angeles, Calif. 90049

[21] Appl. No.: 847,003

[22] Filed: Oct. 31, 1977

[51] Int. Cl.[2] ..... B63H 9/10

[52] U.S. Cl. ..... 114/111; 114/102; 114/104

[58] Field of Search ..... 114/39, 102, 104, 105, 114/108, 111, 112, 113, 114, 115, 204

[56] References Cited

U.S. PATENT DOCUMENTS 4,022,144 5/1977 Gitchel ..... 114/104

*Primary Examiner*—Charles E. Frankfort

[57] ABSTRACT

A spinnaker header and rig adapted to high performance racing sailboats for adjusting the height from which the spinnaker is flown, characterized by gear adjustable as to height along the forestay under control of a halyard and downhaul, and by a backhaul to take the driving force of the spinnaker.

30 Claims, 7 Drawing Figures

X'
E'
A'
B'
C'
D'
10
10'
30
31
42
43
44'
54
55
56
57
58
60
S
Z

ADJUSTABLE SPINNAKER HEADER AND RIG THEREFOR

BACKGROUND

Sailing boats and especially those of the racing classes are characterized by a wide variety of sails, and some of which have become highly specialized. In addition to mainsails, mizzen and stay-sails, there are the head-sails which include various sized jibs and in particular the spinnakers of large area. And it is the spinnaker with which this invention is particularly concerned, inasmuch as sailboat racing requires the ultimate use of such head-sails in order to compete by driving the boat hull to its maximum.

High performance sailboat rigs have evolved into what is referred to as "high aspect ratio rigs", wherein the height of the sails is great in proportion to the length of the hull. That is, masts are taller and booms are shorter than they were in boats of the recent past, and to the end that the moment arm between the roll center and mast head is proportionately increased. In light air this increased lever is no problem and it is possible to maintain a masthead rig and a maximized slot between the jib and the main. But heavy air usually requires a reduction of said moment arm and which has been effected by a compromise wherein the forestay terminates a substantial distance below the masthead, so as to reduce the fore triangle and to provide a lower position for the heads of the various head sails including spinnakers used in both light and heavy airs. Needless to say, this is a restriction of the rig which limits performance in light air while providing a margin of safety in heavy air. It is the so called "knock-down" or "broach" which is to be avoided, the situation which so often occurs when the force becomes so great in a lateral direction at the masthead that the boat heels excessively and/or runs violently out of control, and in many cases end up with the mast almost parallel with the water. However, the yachtsman must carry maximum sail and chance knock-down in order to compete, it being a general object of this invention to permit him to carry maximum sail while reducing the chance of knock-down.

It is the fore-triangle of a sailboat that carries the head-sails and which is comprised of the mast and the forestay separated along the foreward deck and convergent to a point along the mast, and preferably at the head of the mast when maximizing the fore-triangle for light air. In practice, a high aspect mainsail is established by increasing the height of the mast while shortening the boom, and this may be accomplished with or without raising the fore-triangle although it is advantageous to run the forestay to the masthead so as to establish a slot coextensive between the mainsail and headsail. Obviously, this so-called "masthead rig" places the spinnaker halyard sheave at the top of the mast and establishes a lever arm of invariable height or length, a fixed maximum height. The head of the spinnaker is flown therefrom by attachment of a halyard thereto and which is lifted over the halyard sheave to draw therefrom. However with the present invention, it is an object to provide a "spinnaker header" that is adjustable as to height and adapted to be lifted to any point up to the masthead, thereby adjusting the aforesaid lever arm as may be required and accommodating all spinnakers including those of maximum size. That is, by selectively lowering the spinnaker header of the present invention the moment arm can be reduced as circumstances require and greater driving force maintained from larger spinnakers that could otherwise be flown from a masthead.

The "spinnaker header" of the present invention is lifted into position by the halyard and secured thereat by a downhaul, with the head of the spinnaker attached thereto. A feature of this invention is the use of the forestay to guide the spinnaker header on the boat center line to the desired height, it being observed that tremendous and unbearable forces would be created by drawing from the forestay at one intermediate point therealong. That is, it is not feasible to apply the head forces of a spinnaker to an intermediate point along the forestay, and it is therefore an object of this invention to provide means transferring these head forces from the forestay and directly to the hull. With the present invention there is a spinnaker backhaul extending to the boat deck substantially aft of the mast and preferably at or near the stern. This spinnaker backhaul is drawn tight through a block at the windward rail so as to clear the mast, preferably between the masthead and spreader thereby to prevent the forestay from being pulled out of alignment.

The "spinnaker header" of the present invention can take various forms dependent upon the type of rigging to which it is to be applied. Stays for example, are made of steel or aluminum of multi strand or of rod form. Furthermore, the arrangement of stays varies greatly from boat to boat, with special adaptations to forestays which are rigged singularly and in pairs as well. To these ends the spinnaker header may be in the nature of hardware or software, as may be required to adapt the same to the particular rigging installation. For example, in one form the spinnaker header X is in the nature of a trolley for running up hard stainless steel rigging, and in another form the spinnaker header X' is in the nature of a saddle for sliding up softer aluminum rigging and/or multiple stays. As will be described, these two related forms of "spinnaker header" have the same broad functional means including generally, centering means A aligning with the forestay, spinnaker coupling means B, halyard coupling means C, downhaul coupling means D, and backhaul coupling means E. These are the features essential to the present invention and which advantageously adapt to the rigging of high performance sailboats so as to maximize performance when sailing before the wind with a spinnaker which can be of increased size by virtue of the reduction in spinnaker head height.

DRAWINGS

The various objects and features of this invention will be fully understood from the following detailed description of the typical preferred forms and applications thereof, throughout which description reference is made to the accompanying drawings, in which.

Figure 2:
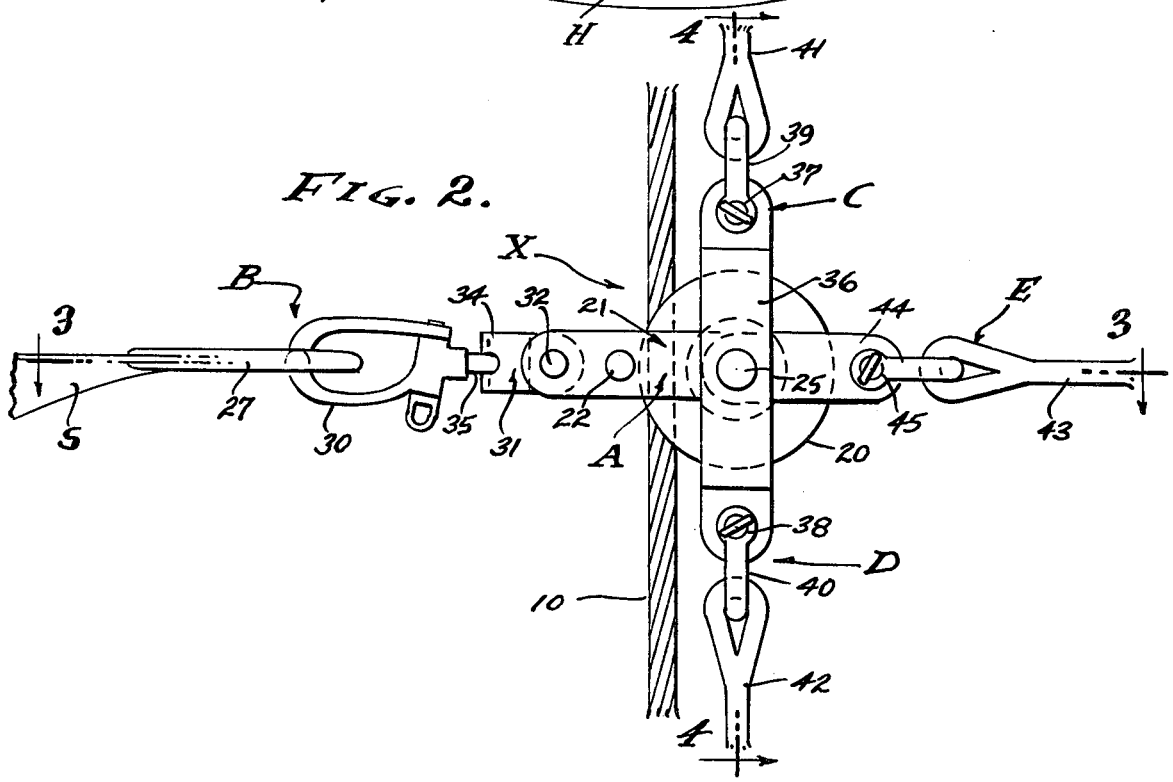
FIG. 2 is an enlarged detailed side view of a first embodiment of the spinnaker header with the sail and rigging lines attached thereto and in position along a forestay.
Figure 4:
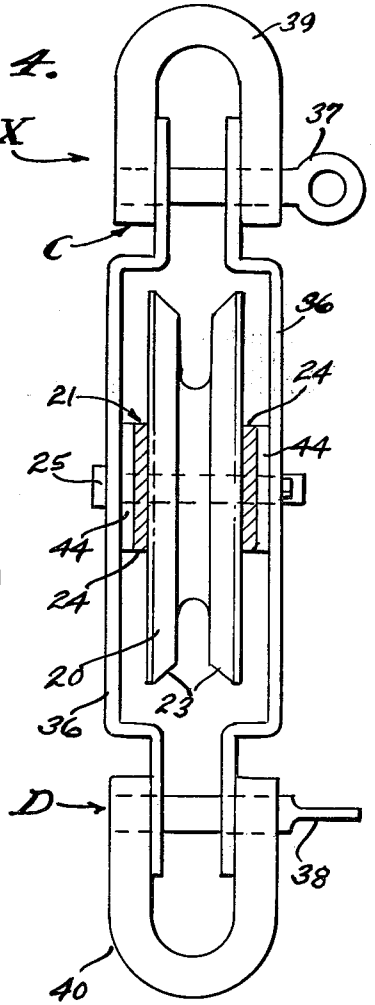
Figure 3:
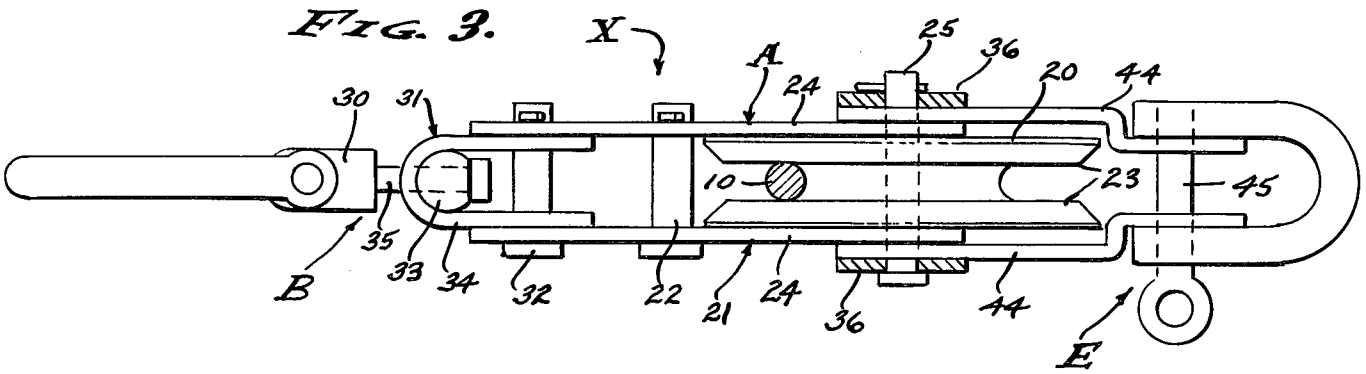

FIGS. 3 and 4 are sectional views taken substantially as indicated by lines 3—3 and 4—4 on FIG. 2.

Figures 5, 6, 7:
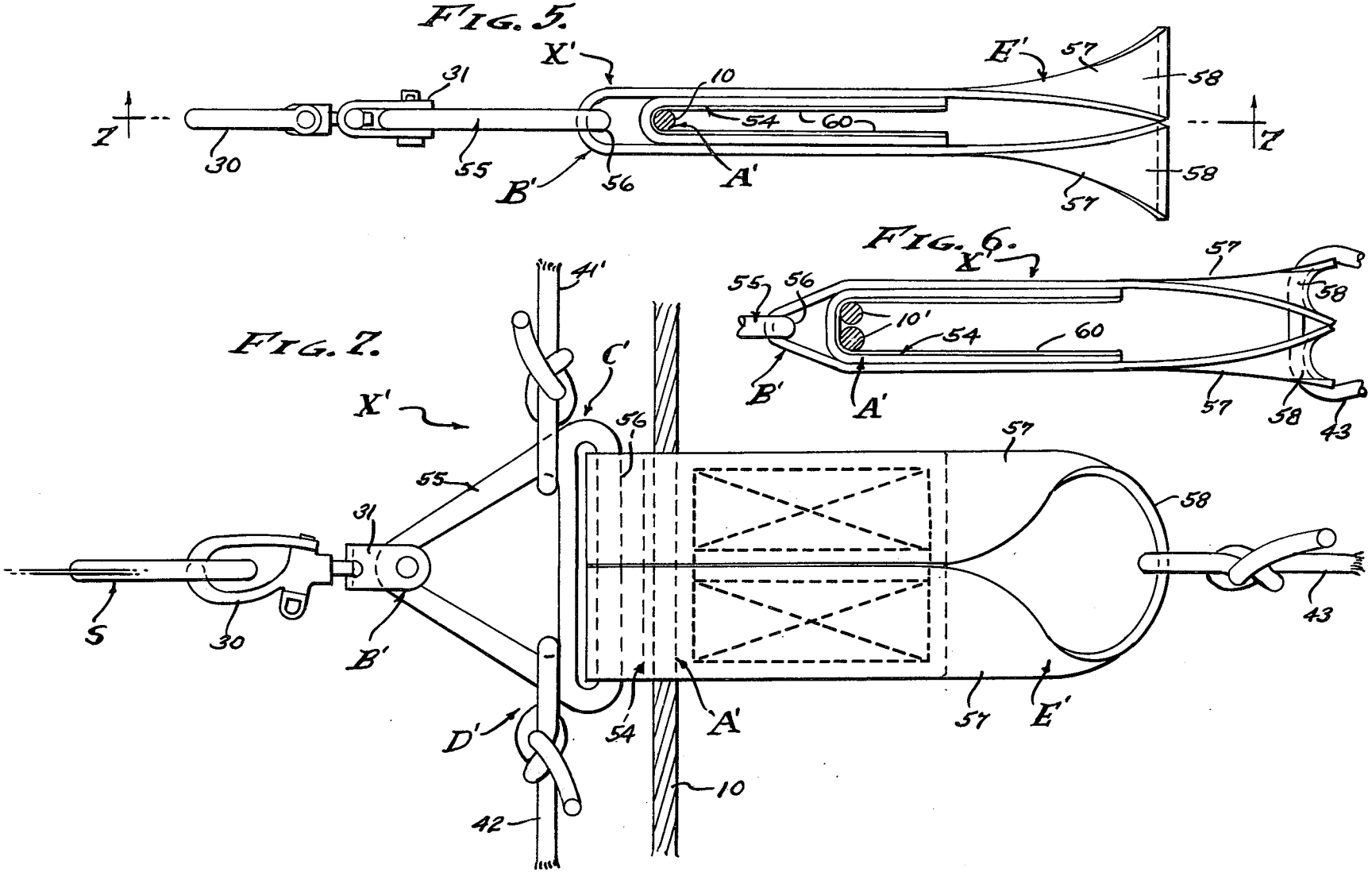

FIG. 5 is a plan view of a second embodiment of the spinnaker header embracing a single forestay.

FIG. 6 is a view similar to FIG. 5 showing the embracement of dual forestays with the backstay attached.

FIG. 7 is a side elevation taken as indicated by line 7—7 on FIG. 6 showing the sail S attached and the rigging which controls position of the spinnaker header.

PREFERRED EMBODIMENT

The sailboat gear of the present invention is characterized by the "spinnaker header" that is adjustably related to the fore-triangle rigging of the craft. In combination with said spinnaker header there is the rigging that will be described as it is employed to control the adjustments desired and to apply the driving force of the spinnaker to the boat hull. Accordingly, the desirable functions are, first to raise or lower the head of the spinnaker to optimum level by means of the usual halyard, second to downhaul the head of the spinnaker, and third to backhaul the head of the spinnaker so as to transfer driving force from aloft and apply it to the boat hull.

The boat hull H is comprised of the usual features including a deck extending between the bow 11 and stern 14 and a mast 15 projecting aloft from the deck to a masthead 12; with the usual backstay 16, forestay 10 and shrouds 17 to the opposite rails 18 that extend from bow to stern. Significantly, spreaders 19 project laterally from the mast 15 to guide the outer shrouds 17, a masthead rig being shown wherein the forestay 10 reaches to the extreme top of the mast 15 so as to maximize the fore-triangle and the height of the halyard sheave (not shown) for flying a maximized spinnaker in light air.

Referring now to the hardware form of the present invention, as is shown in FIGS. 1–5, the spinnaker header X is comprised of a trolley that runs up the forestay 10 between the bow 11 of the hull H and the head 12 of the mast 15. In this form of the invention, the centering means A is a guide that surrounds the forestay with clearance so as to be free to run therealong, preferably an antifriction guide involving a roller or wheel 20 engageable on the forestay 10 and a frame 21 to which the wheel 20 is journaled, there being a keeper 22 to close the wheel and frame around said stay. In practice, the wheel 20 is deep throated and with flanges 23 between which the forestay passes. The frame comprises a pair of straps 24 to which the wheel is journaled by a bearing pin 25, the keeper 22 being a removeable pin disposed close to the periphery of the spaced flanges 23. Cotters are employed to secure the pins 22 and 25. Note that in the embodiment shown the trolley wheel 20 is aft of the forestay 10, in which case the halyard coupling means and downhaul coupling means are also aft of the forestay in alignment with the bearing pin 25; however, it is to be understood that this trolley disposition and halyard-downhaul alignment can be disposed forward of the forestay when circumstances so require. Thus, the trolley established by the parts and elements 20–25 is adapted to surround a forestay and confined thereto without danger of displacement.

Th spinnaker coupling means B comprises a releasable shackle 30 that is carried forwardly of the frame 21 to be fastened through the head 27 of the spinnaker S, and by a swivel 31 interconnecting the frame 21 and said shackle. In carrying out this invention, the shackle 30 is a quick releasable snap shackle having an opening in one side to receive the bight at and/or the head 27 of the spinnaker S. And, the swivel 31 is a universal means that allows freedom of the shackle to move in any direction and to rotate so as to prevent restraint of the sail. As shown, there are three distinct axes of rotation established by a pivot pin 32 spaced forward from and parallel to the keeper pin 22, a lug 33 on an axis spaced forward from and normal to pin 32 to rotate in the crotch of the swivel body 34, and a shackle stem 35 rotatable through the lug 33 on an axis normal to the turning axis of the lug and projecting through a slot-shaped opening in the body 34 to swing from side to side. Thus, the spinnaker coupling means B is articulated to disengageably secure the spinnaker head 27 without restraint.

The halyard coupling means C and downhaul coupling means D are combined as diametrically disposed bails extending oppositely from the bearing pin 25. In practice, the bails are comprised of a pair of diametrically disposed straps 36 carried by the bearing pin 25 with aligned openings at opposite ends to receive the removable pins 37 and 38 of the halyard and downhaul shackles 39 and 40 respectively. Accordingly, the strap bails of means C and D are aligned with the forestay 10 to haul up and down the rig as required, the halyard line 41 being spliced to the shackle 39 and a downhaul line 42 being spliced to the shackle 40, as shown.

Figure 1:
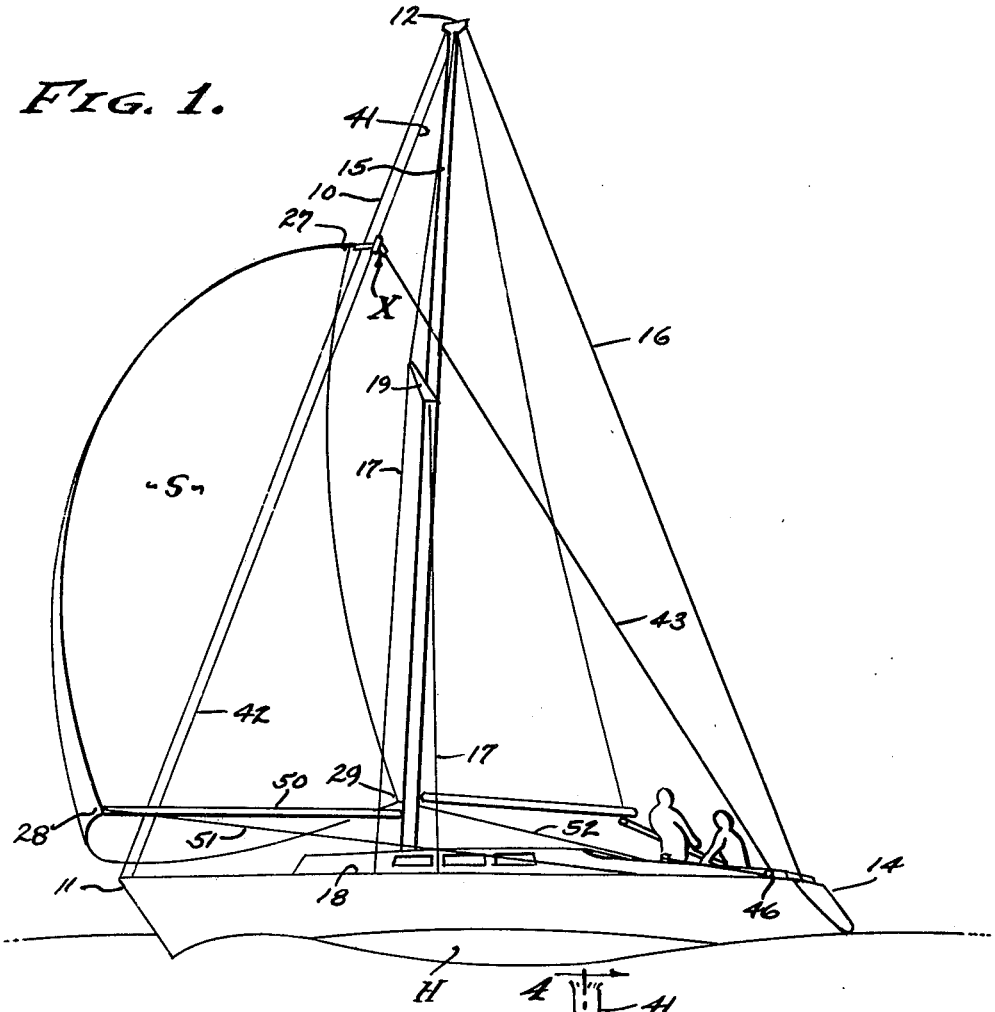
FIG. 1 is a pictorial view of the spinnaker header of the present invention in use.

In accordance with this invention, the backhaul means E is provided to transfer the pulling force of the spinnaker from the head 27 thereof to the boat hull, preferably to the windward rail 18 at the stern of the hull H. In practice, a spinnaker S will be flown from the upper portion of the forestay 10, in which case a backhaul 43 is trained over the spreader 19 at the windward side of the mast 15, or one at both sides as circumstances require. Accordingly, the means E comprises bail straps 44 swinging radially from the bearing pin 25 to extend rearward from the snap shackle 30 with aligned openings at its end to receive the removable pin 45 securing the backhaul 43. The bail straps 44 of means E are aligned with the backhaul 43 to position the bearing pin 25 as required so as to remove pulling force and strain from the forestay 10, the backhaul 43 being secured through a swivel block 46 at the rail 18 where it is drawn through a winch and adjustably cleated to the deck. In the example of FIG. 1, the spinnaker header has been adjusted to 75% of the mast height and the spinnaker pole 50 lowered to correspond, with a guy 51 leading from the tack 28 and a sheet 52 leading from the clew 29 in the usual fashion.

It is to be understood that the halyard 41, downhaul 42, backhaul 43, guy 51 and sheet 52 are all rigged and handled on deck by means of the usual tackle and with the aid of winches, as circumstances require. The extraneous rigging used in supporting the spinnaker pole 50 is ommitted for clarity of the few simple lines 41, 42 and 43 which are uniquely combined in the present invention. It will be apparent that placement of this spinnaker header by the halyard 41 and downhaul 42 will be determined by the size of the optimum spinnaker, not to exclude storm spinnakers with the backhaul 43 trained between or below the spreader or spreaders 19.

Referring now to the software form of the present invention, as it is shown in FIGS. 5 through 7, the spinnaker header X′ is comprised of a saddle that slides up the forestay 10 (FIG. 5) or forestays 10′ (FIG. 6) between the bow 11 of the boat hull H and the head 12 of the mast 15. This embodiment is particularly suited to stays of softer metals and/or to multiple stay installations. Characteristically therefore, the centering means A′ is a guide that embraces the forestay installation so as to be free to slide therealong, preferably an anti-chafing member 54 of U-shaped configuration wrapped around the front and extending rearwardly from each side of the forestay. In practice, heavy woven belting is used in fabricating the saddle so as to combine and thereby establish a centering means A' and an anchor for the backhaul means E'; while the spinnaker coupling means B', halyard coupling means C' and downhaul coupling means D' are combined in a single coupling element 55 of ring-shape, preferably of triangular form. Accordingly, the triangle base 56 is disposed in alignment with the forestay installation so that its two corners receive the halyard 41 and downhaul 42 respectively, or shackles 39 and 40 while the apex of the triangle is disposed forwardly to receive the swivel 31-shackle 30 of the spinnaker coupling means B. Note the halyard-downhaul alignment forward of the forestay, in which case the conventional outside spinnaker halyard line 41' is employed, as distinguished from an inside jib or genoa halyard, together with an outside downhaul line 42'.

The strapping of the software embodiment can be secured together, as by sewing, in various manners. As shown, the aforesaid wrap around anti-chafing member 54 is of a width to fully occupy the base of the triangular coupling element 55 and extends free to the rearward of the forestay installation a substantial distance, the ends thereof terminating side by side. Note that this strapping does not pass through the coupling element, but in accordance with this invention is secured thereto by strapping 56 which comprises the backhaul means E' superimposed around the anti-chafing member 54, preferably half width strapping 57 (as shown) looped at 58 from opposite ends of the member 54 and the ends of which will extend around the base of coupling element 55 and sewn to both rearwardly extended portions of the member 54, thereby presenting multi thickness of strapping for durability. The anti-chafing member 54 has lining 60 as shown, and the loops at 58 are drawn together and the backhaul 43 fastened thereto as by means of a shackle or bowline knot as shown.

From the foregoing it will be seen that I have provided a practical spinnaker rig for high performance sailboats, characterized by its ability to reduce the moment arm imposed by spinnaker forces applied in heavy winds. Significantly, the ability of carrying the spinnaker at maximum height is not impaired, whereby maximum sized spinnakers can be used in light wind.

Having described only typical preferred forms and applications of my invention, I do not wish to be limited or restricted to the specific details herein set forth, but wish to reserve to myself any modifications or variations that may appear to those skilled in the art.

I claim:

1. A spinnaker header for supporting a spinnaker sail and adjustable as to height along a forestay extending to a mast projecting aloft from a sailboat hull, and including; centering means guiding the header along the forestay, spinnaker coupling means securing the head of the spinnaker to the header and receiving the pulling force from said spinnaker, halyard coupling means securing a halyard line to the header to raise the header, downhaul coupling means securing a downhaul line to the header to lower the header, the said halyard line and said downhaul line cooperating to position the said header as to height along the forestay, and a backhaul coupling means securing the header to the boat hull to transfer pulling force from the header to said hull.

2. Th spinnaker header as set forth in claim 1, wherein the centering means comprises means embracing the forestay to move freely therealong.

3. The spinnaker header as set forth in claim 1, wherein the centering means comprises a trolley embracing the forestay to roll anti-frictionally therealong.

4. The spinnaker header as set forth in claim 1, wherein the centering means comprises a saddle embracing the forestay to slide frictionally therealong.

5. The spinnaker header as set forth in claim 1, wherein the spinnaker coupling means comprises a shackle extending forwardly from the header and from the forestay for connection to the spinnaker head.

6. The spinnaker header as set forth in claim 1, wherein the spinnaker coupling means comprises a swivel extending forwardly from the header and carrying a shackle for connection to the spinnaker head.

7. The spinnaker header as set forth in claim 1, wherein the said halyard coupling means and said downhaul coupling means comprise oppositely projecting means extending parallel with the forestay for connection to the halyard line and downhaul line respectively.

8. The spinnaker header as set forth in claim 1, wherein the said halyard coupling means and said downhaul coupling means comprise oppositely projecting shackles extending parallel with the forestay for connection to the halyard line and downhaul line respectively.

9. The spinnaker header as set forth in claim 1, wherein the backhaul coupling means comprises a line extending from the header and secured to the boat hull substantially aft of the forestay.

10. The spinnaker header as set forth in claim 1, wherein the backhaul coupling means comprises a line extending free of the mast and from the header and secured to the aft section of the boat hull.

11. The spinnaker header as set forth in claim 1, wherein the backhaul coupling means comprises a line extending free of the mast and from the header and secured to the windward side and aft section of the boat hull.

12. Spinnaker header hardware for supporting a spinnaker sail and adjustable as to height along a forestay extending to a mast projecting aloft from a sailboat hull, and including; a centering trolley means guiding the header along the forestay and confined thereto by a frame journaled to the trolley means by a bearing pin, spinnaker coupling means pivoted from the bearing pin by said frame and securing the head of said spinnaker to the trolley means to receive pulling force of said spinnaker, halyard coupling means pivoted from the bearing pin and securing a halyard line to the trolley means to raise the header, downhaul coupling means pivoted from the bearing pin securing a downhaul line to the trolley means to lower the header, the said halyard line and said downhaul line cooperating to position the said header as to height along the forestay, and a backhaul means pivoted from the bearing pin and securing the trolley means to the boat hull to transfer pulling force from the header to said hull.

13. The spinnaker header hardware as set forth in claim 12, wherein the centering trolley means comprises a deep throated pulley with flanges to embrace the forestay.

14. The spinnaker header hardware as set forth in claim 12, wherein the centering trolley means comprises a roller engageable with the forestay embraced between two side members comprising the frame.

15. The spinnaker header hardware as set forth in claim 12, wherein the centering trolley means comprises a roller engageable with the forestay embraced between two side members comprising the frame, there being a pin extending between said members confining the forestay juxtapositioned to the roller.

16. The spinnaker header hardware as set forth in claim 12, wherein the centering trolley means comprises a deep throated pulley with flanges to embrace the forestay, there being a pin juxtapositioned to the periphery of the pulley confining the forestay within the pulley flanges.

17. The spinnaker header hardware as set forth in claim 12, wherein the spinnaker coupling means comprises a shackle extending forwardly from a pivot pin carried by the frame and forwardly of the forestay for connection to the spinnaker head.

18. The spinnaker header hardware as set forth in claim 12, wherein the spinnaker coupling means comprises a swivel extending forwardly from a pivot pin carried by the frame and a shackle extending forwardly therefrom for connection to the spinnaker head.

19. The spinnaker header hardware as set forth in claim 12, wherein the said halyard coupling means and said downhaul coupling means comprise integral bails extending diametrically from the bearing pin.

20. The spinnaker header hardware as set forth in claim 12, wherein the backhaul means comprises a bail pivoted from the bearing pin and a line extending therefrom to the boat hull substantially aft of the forestay.

21. The spinnaker header hardware as set forth in claim 12, wherein the backhaul means comprises a bail pivoted from the bearing pin and a line extending free of the mast and from the bail to the aft section of the boat hull.

22. The spinnaker header hardware as set forth in claim 12, wherein the backhaul means comprises a bail pivoted from the bearing pin and a line extending free of the mast and from the bail and secured to the windward side and aft section of the boat hull.

23. Spinnaker header software for supporting a spinnaker sail and adjustable as to height along a forestay extending to a mast projecting aloft from a sailboat hull, and including; a centering saddle means guiding the header along the forestay and combined with a backhaul having coupling means securing the header to the boat hull, spinnaker coupling means securing the head of the spinnaker to the header and receiving the pulling force of said spinnaker, halyard coupling means securing a halyard line to the header to raise the header, and downhaul coupling means securing a downhaul line to the header to lower the header, the said halyard line and said downhaul line cooperating to position the said header as to height while the said backhaul transfers said pulling force of the spinnaker head from the header to the boat hull.

24. The spinnaker header software as set forth in claim 23, wherein the centering saddle means is a pliable member wrapped around the forestay and extended rearward thereof to join with said backhaul coupling means.

25. The spinnaker header software as set forth in claim 23, wherein the centering saddle means is a strap-like member wrapped around the forestay and extended rearward to join with said backhaul coupling means.

26. The spinnaker header software as set forth in claim 23, wherein the centering saddle means is a first pliable member wrapped around the forestay and extended rearward thereof to join the said backhaul coupling means, and wherein a ring receives a portion of a second pliable member forming the backhaul coupling means, the ring forming a portion of the spinnaker coupling means, halyard coupling means and downhaul coupling means inclusively.

27. The spinnaker header software as set forth in claim 23, wherein the centering saddle means is a strap-like member wrapped around the forestay and extended rearward to join with said backhaul coupling means, and wherein a ring receives a portion of a second strap-like member forming the backhaul coupling means, the ring forming a portion of the spinnaker coupling means, halyard coupling means and downhaul coupling means inclusively.

28. The spinnaker header software as set forth in claim 23, wherein the centering saddle means is a pliable member wrapped around the forestay and extended rearward thereof to join with said backhaul coupling means, and wherein the backhaul coupling means is formed of pliable members superimposed over the first mentioned pliable member thereby reinforcing the same.

29. The spinnaker header software as set forth in claim 23, wherein the centering saddle means is a first pliable member wrapped around the forestay and extended rearward thereof to join with said backhaul coupling means, and wherein the base of a triangular ring receives a second pliable member to form the backhaul coupling means, the apex thereof forming a portion of the spinnaker coupling means, and the base corners thereof forming the halyard coupling means and downhaul coupling means respectively.

30. The spinnaker header software as set forth in claim 23, wherein the centering saddle means is a pliable member wrapped around the forestay and extended rearward thereof to join with said backhaul coupling means, wherein the backhaul coupling means is formed of pliable members extending forwardly of the pliable member of the saddle means and wherein a ring is received thereby to form the spinnaker coupling means, halyard coupling means and downhaul coupling means inclusively.

* * * * *